United States Patent [19]

Young

[11] 4,070,048

[45] Jan. 24, 1978

[54] RELEASABLE WINDOW GUARD

[76] Inventor: Philip Young, 1734 N. Frederic, Burbank, Calif. 91505

[21] Appl. No.: 702,910

[22] Filed: July 6, 1976

[51] Int. Cl.[2] ..... E06B 3/68

[52] U.S. Cl. ..... 292/179; 49/57; 49/141

[58] Field of Search ..... 49/55, 56, 57, 62, 141, 49/463, 464; 292/60, 62, 150, 179, 256.73; 85/302, 4, 5 CP, 8.1, 39, 56

[56] References Cited

U.S. PATENT DOCUMENTS

| | | | |
|---|---|---|---|
| 250,592 | 12/1881 | Smith | 49/56 |
| 597,748 | 1/1898 | Shults | 85/5 CP X |
| 600,904 | 3/1898 | Beall | 49/62 |
| 1,664,820 | 4/1928 | Hughes | 292/62 |
| 2,700,172 | 1/1955 | Rohe | 85/39 X |
| 2,891,615 | 6/1959 | Farrell | 292/60 X |
| 3,241,427 | 3/1966 | Bosler | 85/56 |
| 3,269,455 | 8/1966 | Gillotti | 49/463 X |
| 3,548,704 | 12/1970 | Kutryk | 85/56 |
| 3,601,823 | 8/1971 | Isaacs | 85/56 X |
| 3,774,946 | 11/1973 | Hammann | 292/256.73 X |
| 3,794,365 | 2/1974 | Richberg | 292/62 |
| 3,921,334 | 11/1975 | Black | 49/141 X |
| 3,953,939 | 5/1976 | Klein | 49/56 |

FOREIGN PATENT DOCUMENTS

| | | | |
|---|---|---|---|
| 1,110,533 | 12/1955 | France | 49/463 |

*Primary Examiner*—Roy D. Frazier
*Assistant Examiner*—Thomas J. Holko
*Attorney, Agent, or Firm*—Roger A. Marrs

[57] ABSTRACT

A protective guard for ground floor windows of a dwelling or other building is disclosed herein having a barred grill or grid network releasably secured to the exterior edge marginal region of a window frame. The releasable securement includes a bolt extending through selected bars of the grill and through the window frame with a pull-out pin installed on the interior end of the bolt. A compressed, helical spring is situated between the frame and the pin for forcibly urging the release mechanism out of engagement with the bolt when the pin is withdrawn. Release of the bolt frees the grill so that the grill may be readily removed to permit passage through the window by persons or objects.

1 Claim, 6 Drawing Figures

RELEASABLE WINDOW GUARD

BACKGROUND OF THE INVENTION

1. Field of the Invention

This invention relates to an improved window guard and, more particularly, to a novel safety window means for releaseably securing the guard to the frame defined in the window so that the guard may be detached therefrom in the event of an emergency.

2. Brief Description of the Prior Art

In the past, it has been conventional practice to place an iron grill or grid network over the exterior of a window so as to prevent intruders from passing therethrough. Normally, a plurality of bars are arranged in rows and each of the bars are securely fastened to the window frame by the means of bolts, screws or other permanent fasteners.

Although these conventional window guards have operated for their intended purpose to prevent uninvited passage through the window, the bars present an obstruction in the event an emergency arises such as a fire. Persons within the building cannot escape through the window and fire fighters cannot enter the building through the windows having such bars. Some prior art fasteners have been employed for mounting the bars or guards onto the windows but these fasteners are unsuccessful in providing for a quick release. Such examples of prior art are shown in U.S. Pat. Nos. 2,589,878; 1,507,478; and 377,624. These prior devices of the prior art either do not provide guards with a means for immediate release or, do not provide for any form of automatic dispersal of the parts after release so that a complete freedom of the guard and therefore removal from the window is produced.

Therefore, a long standing need has existed to provide a novel window guard having releaseable means so that the guard may be readily removed from the window in the event of an emergency.

SUMMARY OF THE INVENTION

Accordingly, the above problems and difficulties are obviated by the present invention which provides a novel releaseable window guard having releaseable attachment means for securing the edges of the guard to the exterior edge marginal region of a window frame. The releaseable securement means includes a bolt mounted through selected ones of the bars and which extends through the window frame so as to terminate in a pull-out pin installation at the interior side of the window frame. The pull-out pin is held in the shank of the bolt and is prevented from inadvertent removal by the tension of a resilient member which bears against the frame and the pin. Preferably, a mechanism further includes a retainer cap for covering the spring and operates as a member against which the spring presses so as to hold the pull-out pin in place.

Therefore, it is among the primary objects of the present invention to provide a novel, releaseable securement for a window guard whereby the securement may release the window guard for immediate removal from the window so that it will not operate as an obstruction.

Another object of the present invention is to provide a novel window guard release mechanism which is substantially automatic in that resilient means are used to completely separate the release mechanism from the window.

Still a further object of the present invention is to provide a novel window guard having releaseable means securing the guard to the window whereby manual removal of a pin effects automatic release of the window guard from its supporting structure so that it may be readily pushed or removed from the window.

A further object of the present invention is to provide a novel, releaseable securement means for holding a barred window guard to a window frame that may be readily removed from the interior of the building in the event of an emergency so that the window guard may be removed from the window as an obstruction.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF THE PREFERRED EMBODIMENT

Figure 1:
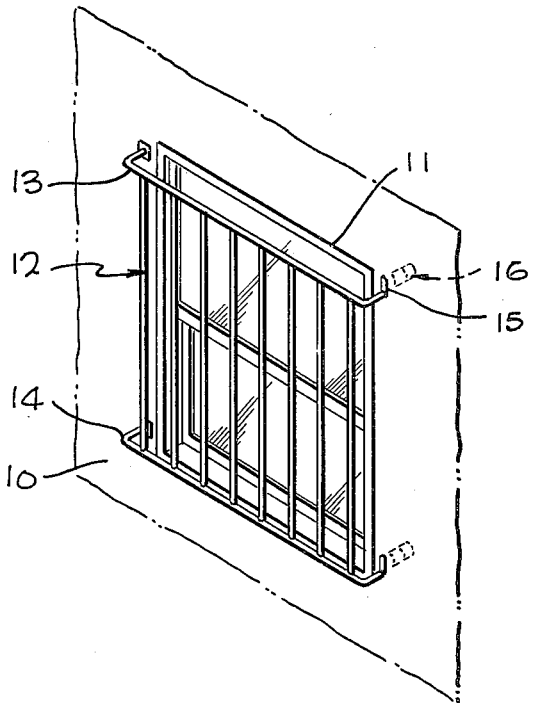
FIG. 1 is a perspective view of a window guard installed on the exterior surface of a building about the edge marginal regions of a window frame and which incorporates the releaseable securement means of the present invention.
Figure 3:
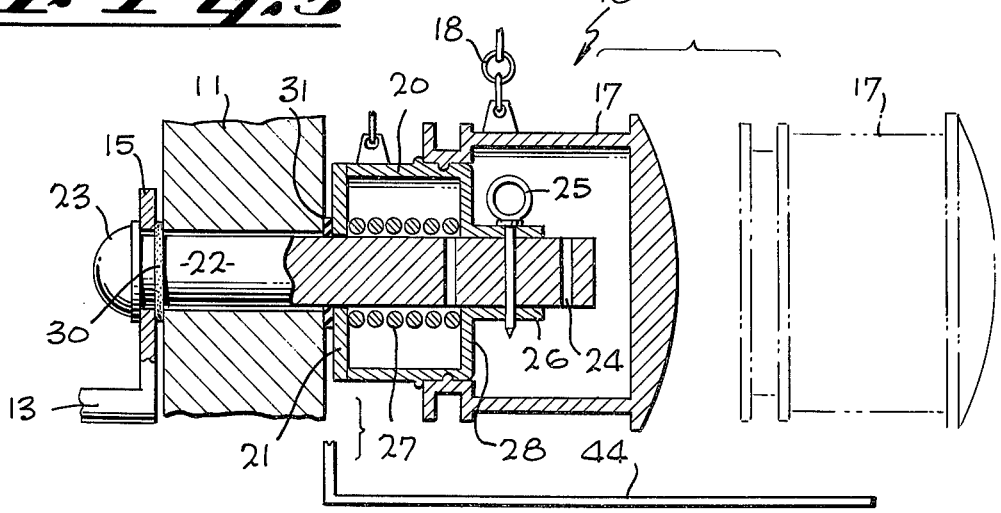
FIG. 3 is a longitudinal cross sectional view of the novel, releaseable securement means shown in FIG. 2 and illustrated in securement position.

Referring to FIG. 1, the wall of a conventional dwelling or building is indicated by numeral 10 and an aperture is formed in the wall 10 to provide a window which is defined by a window frame 11. The opening or aperture of the window is closed or locked by a plurality of bars arranged in a grill or grid network such as indicated by the numeral 12. In one form of window guard or grill 12, a plurality of individual bars are retained at their opposite ends by cross bars 13 and 14 which include legs which are formed with pads engage with the exterior surface of the wall 10 adjacent the frame 11. In accordance with the present invention, the crossbar pads, such as is indicated by numeral 15 in FIG. 3, are secured to the window frame 11 by a releaseable fastening or securement means illustrated in general by numeral 16. The fastening then takes place on the inner or interior surface of the wall 10 and is therefore illustrated in broken lines in FIG. 1.

Figure 2:
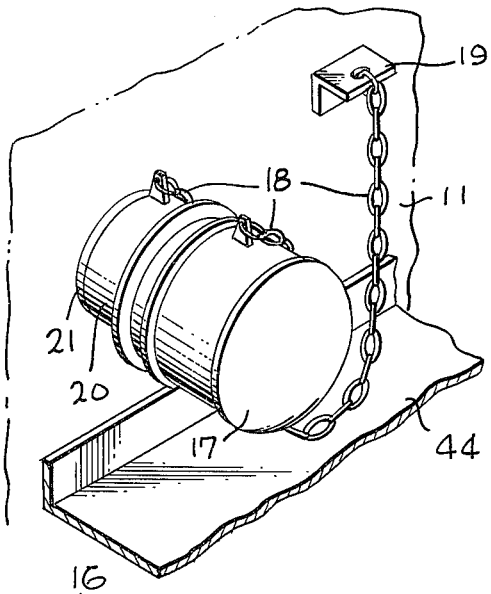
FIG. 2 is an enlarged view of the novel releaseable securement means of the present invention shown from the interior side of the window.

As illustrated more clearly in FIG. 2, the releaseable securement means 16 is viewed from the inside of the window frame 11 and the means includes a snap-lock cap 17 which covers a portion of the release means. The retainer cap 20 is held by a chain 18 to a fixture 19 mounted on the frame so that when the pin 25 is removed, it will remain in the approximate area for use again. The snap-lock cap 17 is carried on the retainer cap 20 which butts against a stop washer 21 carried on the shank of a securement bolt 22.

Figure 4:
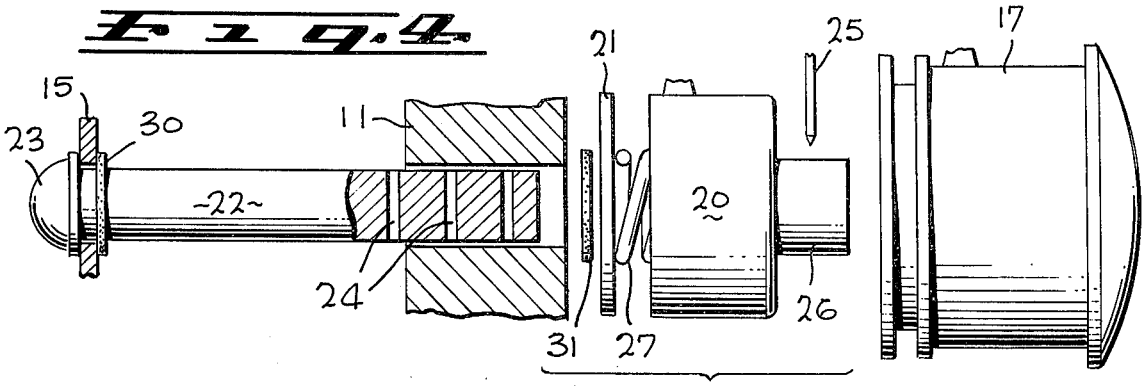
FIG. 4 is an exploded view similar to the view of FIG. 3 and illustrating the component parts of the release mechanism after release.

Referring now in detail to FIG. 3, it can be seen that the bolt 22 passes through a hole in the window frame 11 and the bolt includes an enlarged head 23 at one end with a plurality of holes, such as hole 24 in its opposite end. A pull-out pin or stop pin 25 is inserted through index or register opening in a collar 26 carried on one end of retainer cap 20. The stop pin 25 in cooperation with the retainer cap 20 prevents the bolt 22 from being pulled through its mounting on the window frame 11. To further maintain the stop pin 25 in position on the shank 22 of the bolt, a spring 27 is provided which is compressed between a shoulder 28 of the retainer cap 20 and one side of washer 21. Preferably, rubber washers 30 and 31 are employed for completing the securement assembly or means 16. As shown in broken lines in FIG. 3, the cap 17 has been removed preparatory to releasing the securement and in FIG. 4, the pin has been removed due to the fact of being released. Referring more closely to FIG. 4, it can be seen that the snap-lock cap 17 has been removed so that manual access to the stop pin 25 may be had. By removing the stop pin 25 from the bolt, the retainer cap 20 is forcibly urged from the shank of the bolt by the expansion of the compressed spring 27. Washers 21 and 31 are also free to be removed from the shank of the bolt. The bolt 22 may be readily extracted from the bore in the frame 11 for complete removal of the window guard.

Figure 5:
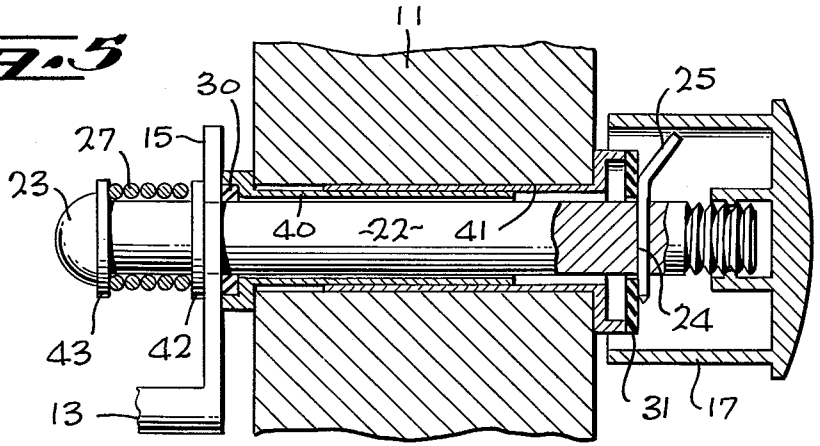
FIG. 5 is a longitudinal cross sectional view of another embodiment of the present invention.

Referring now to FIG. 5, another embodiment of the present invention is illustrated wherein the bolt 22 is inserted through a pair of telescoping sleeves indicated respectively by numeral 40 and 41. Numeral 40 indicates an inner sleeve while numeral 41 indicates an outer sleeve having their adjacent ends telescoping one within the other. The opposite ends of the respective sleeves are provided with collars in which washer 30 is held on the inner sleeve 40 and against which retainer washer 31 is held with respect to outer sleeve 41. However, it is noted that the cap 17 is secured to the shank of the bolt by a threaded attachment so that a more deliberate removal procedure is required preparatory to releasing the window guard securement. Also, it is to be noted that the stainless steel or brass (non-corrosive material) spring 27 is compressed between washers 42 and 43 located between the head 23 and the pad 15 of the window guard.

Figure 6:
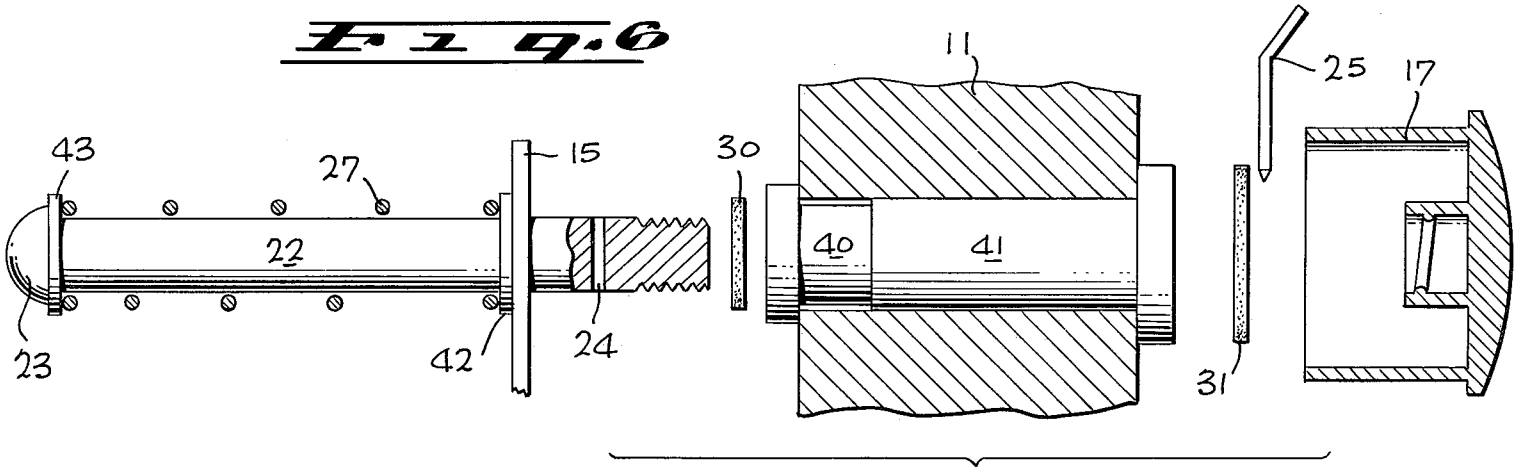
FIG. 6 is an exploded view of the mechanism shown in FIG. 5 after removal of the pin.

As shown in FIG. 6, when the cap 17 has been removed from the end of the shank of bolt 22, the pin 25 may be manually removed and the expansion tension of spring 27 takes over to forcibly urge the bolt outwardly from its installation within the inner sleeve 40. By this means, the bolt 22 is automatically withdrawn and thrown clear of the assembly so that the window guard will fall of its own weight from the vertical side of the window.

In view of the foregoing, it can be seen that intruders are prevented from access to the interior of the building by the presence of the barred window guard. If needed, a guard plate 44 may be used to prevent inadvertent removal of the cap 17 or to prevent external access to the release mechanism. However, in times of emergency, the cap 17 may be removed so as to expose the pin for manual grasping and removal from within the building. Once the pin 25 has been removed the expansion force of spring 27 takes over. With respect to the embodiment shown in FIGS. 2–4, the spring will forcibly urge the retainer cap 20 from the bolt and the bolt may be manually moved or the entire window guard may be pushed so as to withdraw the bolt from installation on the frame 11. With respect to the embodiment shown in FIGS. 5 and 6, the expansion force of spring 27 will automatically withdraw the bolt from its installation and the bar will immediately fall.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

I claim:

1. A mounting device comprising the combination of:

a window frame;

a window guard;

detachable mounting means releasably securing said window guard to said window frame;

each of said mounting means including a headed bolt having a shank passing through said guard and said frame so as to project outwardly from the interior surface of said frame;

pin means removably carried by said bolt shank for retaining said bolt on said frame to support said window guard;

resilient means forcibly and yieldably retaining said pin means engaged with said bolt shank;

a pair of sleeves arranged in telescoping relationship about said bolt shank and each of said sleeves having an enlarged flange exposed adjacent to and bearing against the exterior and interior surfaces respectively of said frame;

said resilient means compressively disposed between the head of said bolt and said window guard;

said bolt being responsive to withdrawal of said pin means to move out of said sleeves in response to expansion of said resilient means;

said bolt shank includes a threaded tip;

a cap threadably engageable with said tip for covering said pin means;

said pin means comprises a straight pin insertably engaged with a registered hole in said bolt shank so as to bear against said sleeve flange opposite to said sleeve flange closest to said window guard; and said pin covered by said cap preparatory to use for releasing said window guard and disposed in close proximity to the interior of said window frame.

* * * * *